US008480517B2

(12) United States Patent
Güttler

(10) Patent No.: US 8,480,517 B2
(45) Date of Patent: Jul. 9, 2013

(54) TRAINING DEVICE

(76) Inventor: Christian Richard Güttler, Berlin (DE)

( * ) Notice: Subject to any disclaimer, the term of this patent is extended or adjusted under 35 U.S.C. 154(b) by 1252 days.

(21) Appl. No.: 12/065,557

(22) PCT Filed: Aug. 3, 2006

(86) PCT No.: PCT/EP2006/007704
§ 371 (c)(1),
(2), (4) Date: Sep. 2, 2008

(87) PCT Pub. No.: WO2007/028468
PCT Pub. Date: Mar. 15, 2007

(65) Prior Publication Data

US 2012/0108365 A1 May 3, 2012

(30) Foreign Application Priority Data

Sep. 2, 2005 (DE) ..... 10 2005 042 740

(51) Int. Cl.
*A63B 69/00* (2006.01)
*A63B 67/00* (2006.01)

(52) U.S. Cl.
USPC ..... 473/446; 473/422; 473/471

(58) Field of Classification Search
USPC ..... 473/422, 451, 431, 459, 446, 473, 473/474, 461, 462, 465, 470, 471; 434/247
See application file for complete search history.

(56) References Cited

U.S. PATENT DOCUMENTS

| | | | | | |
|---|---|---|---|---|---|
| 4,122,822 | A | * | 10/1978 | Scheiwiller | 124/54 |
| 4,185,608 | A | * | 1/1980 | Young et al. | 124/16 |
| 4,352,348 | A | * | 10/1982 | Griffith | 124/78 |
| 4,645,210 | A | * | 2/1987 | Patsy | 473/446 |
| 4,700,952 | A | * | 10/1987 | Patsy | 473/446 |
| 4,735,405 | A | | 4/1988 | Marocco et al. | |
| 5,222,731 | A | | 6/1993 | Hanabusa et al. | |
| 5,249,564 | A | * | 10/1993 | Peachey | 124/17 |
| 5,465,978 | A | * | 11/1995 | Magnone et al. | 473/446 |
| 5,647,747 | A | * | 7/1997 | Macri et al. | 434/247 |
| 5,746,669 | A | * | 5/1998 | Sinsheimer et al. | 473/446 |
| 5,863,266 | A | * | 1/1999 | Starnes | 473/471 |

(Continued)

FOREIGN PATENT DOCUMENTS

| | | | |
|---|---|---|---|
| WO | 9510335 | A | 4/1995 |
| WO | 9907447 | A | 2/1999 |
| WO | 0241954 | A | 5/2002 |

OTHER PUBLICATIONS

International Preliminary Report on Patentability issued in corresponding International Application No. PCT/EP2006/007704, dated Sep. 24, 2007.

*Primary Examiner* — Mitra Aryanpour
(74) *Attorney, Agent, or Firm* — Banner & Witcoff, Ltd.

(57) ABSTRACT

The invention relates to a training device for training a person who uses the training device in a type of ball sport, said device having at least two ball receivers (11), which face the user and are intended to interact with a ball, and at least two ball dispensers (11) for conveying a ball to the user. The invention provides at least one optical and/or acoustic signal transmitter which, by emitting an optical and/or acoustic signal, indicates one of the ball receivers (11) to the user as the selected target for interacting with a ball conveyed to the user by one of the ball dispensers (11).

28 Claims, 2 Drawing Sheets

U.S. PATENT DOCUMENTS

Figure 1:
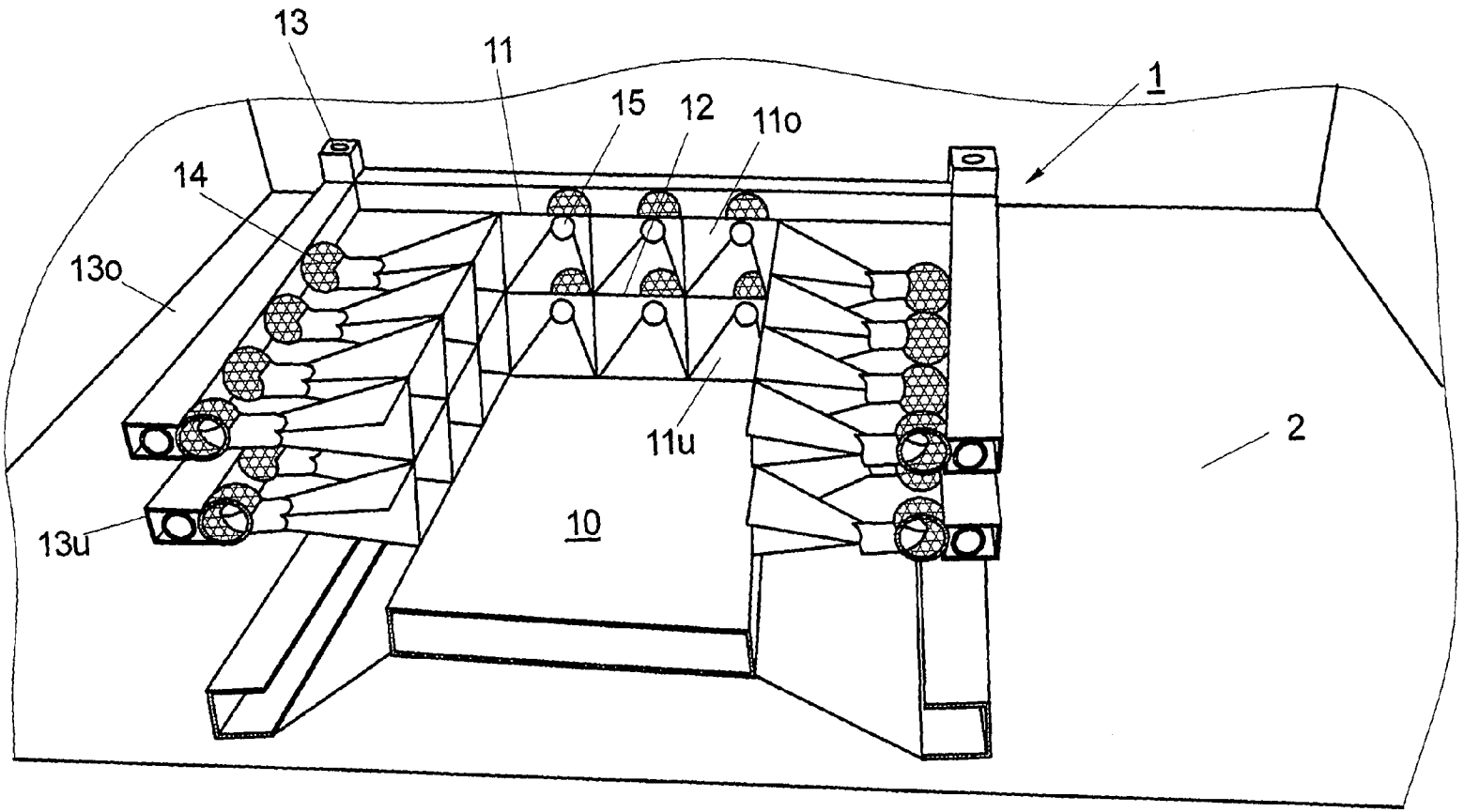

| | | | | |
|---|---|---|---|---|
| 5,911,214 | A * | 6/1999 | Andrews | 124/16 |
| 6,241,628 | B1 * | 6/2001 | Jenkins et al. | 473/436 |
| 6,312,348 | B1 * | 11/2001 | Sandell | 473/415 |
| 7,285,061 | B2 * | 10/2007 | Wagner | 473/459 |
| 7,549,415 | B2 * | 6/2009 | Karellas | 473/471 |
| 7,625,314 | B2 * | 12/2009 | Ungari et al. | 482/1 |
| 7,670,237 | B2 * | 3/2010 | Wagner | 473/446 |
| 7,878,945 | B2 * | 2/2011 | Ungari et al. | 482/1 |
| 2002/0042312 | A1 | 4/2002 | Decloux | |
| 2002/0165048 | A1 * | 11/2002 | Parkinson et al. | 473/459 |
| 2003/0181265 | A1 * | 9/2003 | Raiss | 473/422 |
| 2005/0101417 | A1 | 5/2005 | Hamons et al. | |
| 2008/0269016 | A1 * | 10/2008 | Ungari et al. | 482/1 |
| 2010/0035724 | A1 * | 2/2010 | Ungari et al. | 482/4 |
| 2012/0058835 | A1 * | 3/2012 | Luciano, Jr. | 473/192 |

* cited by examiner

TRAINING DEVICE

This application claims priority of International Application No. PCT/EP2006/007704, filed Aug. 3, 2006. The entire disclosure is expressly incorporated herein by reference.

The invention relates to a training device for training a person who uses the training device in a type of ball sport according to the preamble of claim 1, and to a pertinent method.

Such training devices comprise at least two ball receivers which face the user and are intended to interact with a ball, and at least two ball dispensers for conveying a ball to the user.

A known training device is, for instance, a soccer field with two goals as ball receivers and two ball cannons positioned at the sideline of the playing field as ball dispensers. Alternatively, a person throwing or shooting a ball to one of the players as the user may also be provided as a ball dispenser. The soccer field serves as a playing field. For training the soccer players, balls are supplied by the ball cannons to the soccer players on the playing field; these balls are shot into the goals by the soccer players so as to train, for instance, their shooting technique.

The disadvantage of a soccer field as a training device for coordination consists in that the training intensity is missing and possibilities of variation are lacking. Thus, the user on the playing field is supplied by a predetermined ball dispenser with a ball that he is to shoot into a predetermined goal. This training system is very immobile, and a surprising moment for the user of the playing field is missing since he knows exactly where the ball comes from and where it goes.

The object of the present invention consists in providing a training device that poses a higher challenge to the capacity of reaction and the capacity of coordination of the user, and thus enables higher training efficiency.

This object is solved by a training device with the characteristic features of claim 1. Accordingly, at least one optical and/or acoustic signal transmitter is provided which, by emitting an optical and/or acoustic signal, indicates one of the ball receivers to the user as the selected target for interacting with a ball conveyed to the user by one of the ball dispensers. Thus, it is possible that the user of the training device is informed at very short notice by the signal transmitter to which ball receiver he has to convey the ball.

For the interaction of the ball with the ball receiver, the ball has to be taken at least in the vicinity of the ball receiver. However, whether the ball at least partially penetrates the ball receiver, is received by it, touches it, and/or bounces off it, etc. depends on the exact design of the training device.

The signal transmitter may, for instance, be a loudspeaker announcing the selected ball receiver, or a light beam pointing to the selected ball receiver. The signal transmitter indicates into which ball receiver the user of the training device has to play the ball. Thus, it is possible that the user is informed at short notice only of the current ball receiver. Such a training device is particularly suited to train the coordination of the user since the user only knows where to play the ball after the signal has been transmitted. Thus, it is in particular the capacity of reaction and the capacity of coordination of the user that are trained by the training device.

The training device according to the invention has the advantage that the user first of all does not at all know to which ball receiver he is to convey the ball supplied on the playing field by one of the ball dispensers since the ball receiver that is selected as the target is indicated by the signal transmitter as the current target at short notice only. In the training device, at least two ball receivers are arranged such that the user of the training device can convey to them a ball supplied to him. It is provided that the user conveys the ball to the selected ball receivers in the manner envisaged for the type of sport. For a soccer trainer, this would, for instance, be a shot by foot or by head while a basketball trainer or a handball trainer, for instance, comprises at least two ball receivers into which the ball supplied may be thrown, a golf ball is hit, etc. The ball may be a classical ball such as, for instance, a soccer ball, a basketball, a handball, or a golf ball, but also a ball-like object such as, for instance, a puck or a football which is to be conveyed into a particular area (goal, basket, etc.) for gaining points in the type of ball sport.

Preferably, an optical and/or acoustic signal transmitter is assigned to each ball receiver, wherein the signal transmitters are designed and provided to indicate the ball receiver assigned to them as the target of a ball that one of the ball dispensers conveys on the playing field. The signal transmitters may be arranged at the ball receivers. Thus, for instance, flashlights, in particular LEDs, and/or loudspeakers or megaphones may be arranged at the ball receivers, which either emit a short-time signal only, or emit a signal until the ball has been received by the selected ball receiver. The arrangement of the signal transmitters at the respective ball receiver makes it easy for the user of the training device to assign the signal transmitters to their respective ball receivers.

In a preferred embodiment, the training device defines a playing field or the training device comprises a playing field, respectively, on which the user stays when training with the training device. The playing field depends on the respective type of ball sport: Thus, if the type of ball sport is, for instance, soccer or handball, the playing field is a turf or gym area, for a water ball trainer it is a swimming pool.

In this embodiment, the ball dispensers and/or the ball receivers are preferably positioned at a boundary of the playing field and are facing the playing field. This facilitates the conveying of the ball on the playing field and the access of the ball receivers from the playing field.

In this respect, it is provided in a particularly preferred manner that the playing field comprises at least one ball dispenser and/or ball receiver at all sides of the playing field. A square playing field would thus have at least four ball receivers and four ball dispensers. Thus, it is possible that the ball dispensers dispense balls to the user from all sides of the playing field, and ball receivers may also be selected as targets at all sides of the playing field. This increases the feasible possibilities of variation for the ball conveyance on the playing field and for the ball disposal to the ball receivers, and is thus an increased challenge to the capability of reaction and the capability of coordination of the user.

It may in particular be provided that the playing field ins completely limited by the ball dispensers and/or the ball receivers. The playing field is surrounded by a wall consisting of ball dispensers and ball receivers, so that a grid-like resolution of the possible directions for the ball conveyance on the playing field and for the ball disposal to the ball receivers is generated. It has shown that the capability of coordination of sportsmen is challenged to a higher extent if the ball may come from many different directions and may be played in many different directions.

In one embodiment, the ball dispensers are simultaneously designed as ball receivers and ball dispensers. This combination of ball dispensers and ball receivers in one device element increases the number of ball dispensers and ball receivers which can be positioned at the sideline of the playing field if the space is limited.

Preferably, a plurality of ball dispensers and/or ball receivers are arranged on top of each other, so that ball receivers and/or ball dispensers cannot just be positioned, for instance, on the floor only, but also a plurality thereof on top of each other. This further increases the number of directions from which a ball may be supplied on the playing field, or the number of directions along which the ball is to be conveyed from the playing field to one of the ball receivers.

Preferably, an optical and/or acoustic signal transmitter is assigned to each ball dispenser, wherein these signal transmitters are designed and provided to indicate the respectively assigned ball dispenser as the selected ball dispenser that will convey a ball on the playing field. These signal transmitters indicate to the user from which direction he has to expect the ball. The signals for characterizing the selected ball dispenser and ball receiver may be different so as to better indicate to the player from where he has to expect the ball and where he has to play the ball. Thus, the signal transmitters for the ball receiver may, for instance, flash in another color than the signal transmitters for the ball dispensers, or the ones may be designed as acoustic signal transmitters and the others as optical ones, respectively, etc.

The training device preferably comprises a random generator for selecting one of the ball receivers as the target of a ball. By the random generator, it is possible to select a ball dispenser at random. By the random generator, it is enabled not just to train particular training programs, but also moves that have been selected at random.

In one embodiment, a returning device is provided which returns a ball from one of the ball receivers to one of the ball dispensers. This enables a quick repetition of the training process and thus increases the challenges for the user. Preferably, each ball receiver is provided with such a returning device so as to return the balls automatically to the ball dispensers. If the ball dispenser and the ball receiver are combined in one single element, the returning device may also serve to distribute the balls evenly to the ball dispensers again.

The training device preferably comprises a control device controlling the signal transmitters and the ball dispensers. If applicable, the control device may also serve to control a random generator. By the control device, the training process may be controlled (e.g. accelerated or slowed down), or the direction may be controlled into which the ball is to be played and from which the ball is conveyed on the playing field.

In one embodiment, a timing device measures the time required by a user of the training device for conveying a ball from one of the selected ball dispensers to one of the selected ball receivers. By the measuring of this time, it is possible to measure the quickness of the user, or else the time required by the user to bring the ball under control and to convey it to the ball receiver.

Preferably, memory means store data of a user of the training device which are measured by a sensor. If, for instance, receiving sensors register whether a ball has been received by the selected ball receiver or not, the memory means stores whether the user has conveyed the ball into the selected ball receiver, and how much time the user needed to do so. By means of a pulse monitor that measures the pulse of the user, it is also possible to measure the stress of the user as a function of time.

In so doing, the memory means can store user-related data that are, for instance, measured by a timing device. Thus, it is possible to store the data of different users and compare them with each other. It is also possible to observe the data of a single user over a lengthy period and to note possible improvements or aggravations of his training state.

It is preferably provided that the memory means stores the time as a function of the respectively selected ball dispensers and ball receivers. The stored data enable a comparison of different users in particular playing situations.

Preferably, the ball dispensers are constructed mechanically and adapted to be controlled electronically, just like the ball receivers.

The object underlying the invention is further solved by a method according to claim 22 for training a user being on the playing field of a training device in accordance with the invention. The method comprises the following steps:

selecting a ball receiver for interaction with a ball, emitting an optical and/or acoustic signal by the signal transmitter to indicate the selected ball receiver, and conveying the ball to the user by one of the ball dispensers.

After the selecting of a ball receiver, it is indicated to the user by an optical and/or acoustic signal. The user is given a ball by one of the ball dispensers which the user has to play into the selected ball receiver.

Preferably, a receiving sensor registers whether the ball is received in the selected ball receiver. Thus, a move has been finished and a new one can start.

Preferably, it is provided that, prior to the conveying of the ball on the playing field, a ball dispenser is selected which an optical and/or acoustic signal transmitter is assigned to and which emits a signal before the selected ball dispenser conveys the ball on the playing field. It is thus possible for the user to prepare for the conveying of the ball. It may also be provided that both the selected ball dispenser and the ball receiver are indicated to the user by a corresponding signal prior to the conveyance of the ball. The user has a short time to prepare for the move and is then played a ball by the selected ball dispenser.

In one embodiment, a controlled oxygen reduction for the user is generated on the playing field. Thus, the endurance of the user is trained better. The oxygen control may, for instance, be performed by an air-tight covering of the training device and an oxygen pump, or by oxygen control in a gym in which the training device is installed.

The method is preferably repeated, so that a plurality of balls are consecutively conveyed on the playing field for the user, which he has to play into the selected ball receivers pursuant to the type of ball sport.

Figure 2:
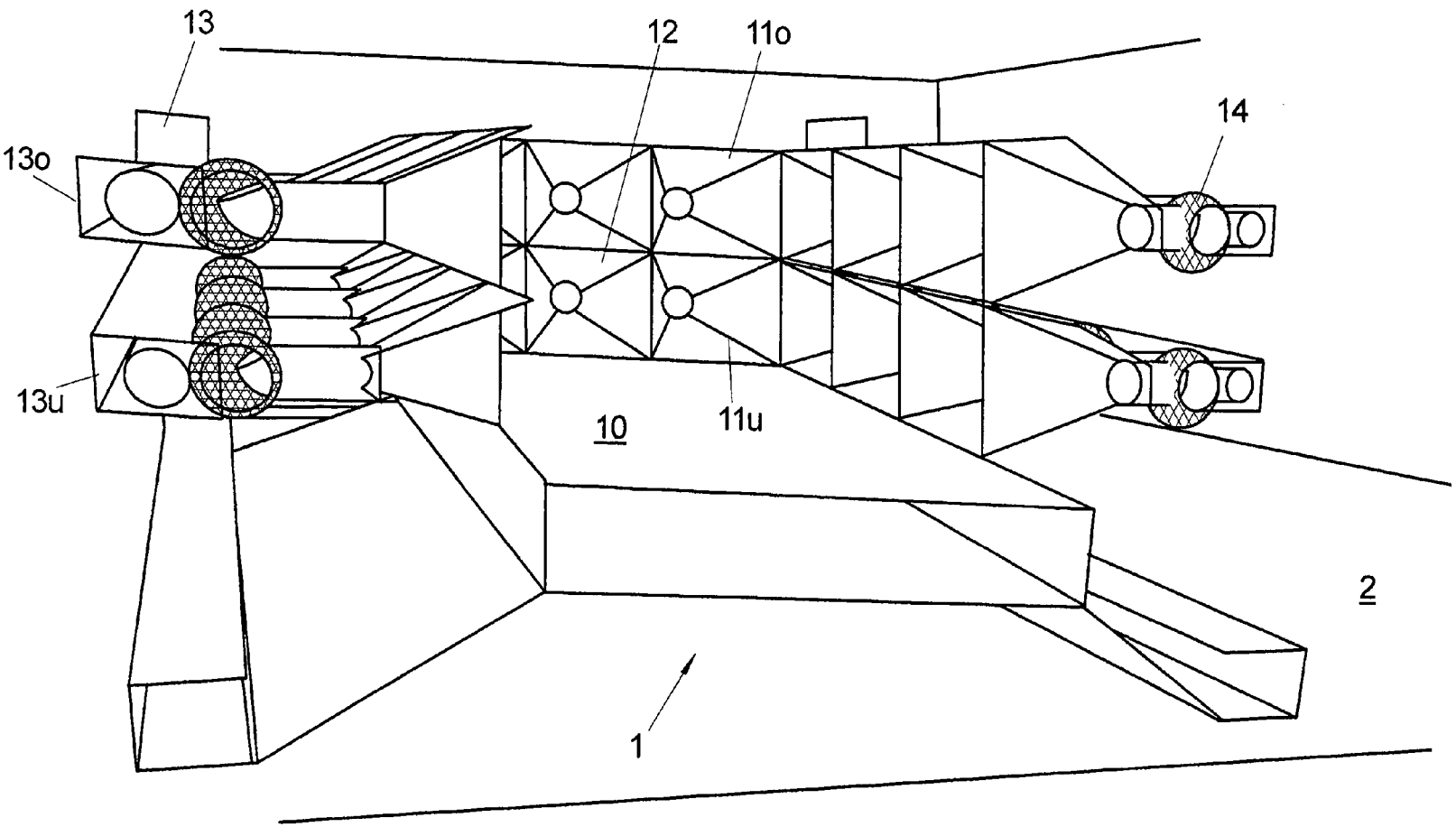

The invention will be explained in more detail in the following by means of an embodiment illustrated in the figures. There shows:

FIG. 1 a schematic section through a soccer training device with a playing field that is limited at all four sides by ball dispensers and ball receivers arranged on top of each other and side by side, and FIG. 2 a perspective section through the soccer training device of FIG. 1.

FIGS. 1 and 2 each show a schematic, perspective section through a training device 1 from different perspectives. The training device 1 comprises a playing field 10 and is surrounded by combined ball dispensers and ball receivers 11. A returning device 13, 13*o*, and 13*u* serves to distribute and to return soccer balls shot into the combined ball dispensers and ball receivers 11.

The training device 1 is a soccer training device. It is positioned in a gym 2, but it may also be positioned outdoor, in particular on a turf.

The playing field 10 serves as a playing field for the user of the training device. If a user wants to be trained by the training device 1, he stands on the playing field 10 and waits for the conveyance of a soccer ball as a ball by one of the ball dispensers 11.

The ball dispensers 11 serve simultaneously as ball dispensers and as ball receivers. This means that such a combined ball dispenser and ball receiver 11 can convey a soccer ball on the playing field 10 and also serves as a goal for receiving a ball played by the user into the combined ball dispenser and ball receiver 11.

The playing field is dimensioned such that a user being on the playing field 10 can reach all the ball receivers 11, irrespective on which side of the playing field they are arranged. Reaching in this context means that the user is able to convey the ball to the ball receivers in the manner typical for the type of ball sport, in the case of soccer thus shooting or playing by head. For a soccer trainer as a training device 1, a playing field 10 that has a dimension of approx. 6×10 m is, for instance, suited.

The playing field 10 is exchangeable and may both consist of turf (e.g. artificial turf) and of a classical gym floor material. Alternatively to an exchangeable playing field, the training device 1 may also have no floor at all, so that the user would be trained on the floor of the gym 2.

The combined ball dispensers and ball receivers 11 are arranged at all four sides of the playing field and are facing the playing field 10. The side of the training device 1 that is facing the viewer in FIG. 1 is cut off by the sectional illustration. The training device 1 is, however, by no means open at this side, but comprises here, too, like at the opposite side, combined ball dispensers and ball receivers 11.

The combined ball dispensers and ball receivers 11 comprise a substantially square opening 15 that serves as a goal and that limits the playing field 10 at one side. Behind the opening 15, the combined ball dispensers and ball receivers converge in a funnel shape and finally open, at the side facing away from the playing field 10, into a round ball reservoir 14 that serves to store balls that may be conveyed on the playing field 10. The ball reservoir 14 is coupled to a returning device 13 with its side facing away from the playing field.

The combined ball dispensers and ball receivers 11 are arranged in two rows on top of each other, so that, for instance, the combined ball dispenser and ball receiver 11*o* is arranged above the lower combined ball dispenser and ball receiver 11*u*. The openings 15 have a dimension of approx. 2×2 m, so that three combined ball dispensers and ball receivers are arranged side by side at the narrower sides of the playing field of the training device 1 illustrated in the Figures, and five are arranged side by side at the longer sides of the playing field. Moreover, an upper row of ball dispensers and ball receivers is arranged above the lower row of combined ball dispensers and ball receivers, so that the training device 1 comprises a total of 32 combined ball dispensers and ball receivers 11.

The lower ball dispensers and ball receivers 11*u* are connected in the ball reservoir 14 with a lower returning pipe 13*u* of the returning device 13 while the upper ball dispensers and ball receivers 11*o* are connected with an upper returning pipe 13*o*. Through the returning device 13, 13*o*, and 13*u*, the ball reservoirs 14 are filled with balls, or balls are taken from the ball reservoir 14, respectively, if a ball reservoir 14 contains more than a predetermined number of balls.

Each of the combined ball dispensers and ball receivers is provided with a signal transmitter. In the training device of FIGS. 1 and 2, the signal transmitter is designed as an optical signal transmitter and gives a signal in that it emits light of a particular color along the opening 15 of one of the combined ball dispensers and ball receivers 11. The signal transmitter may, for instance, be implemented in that it consists of LEDs that are arranged along rods forming the opening 15. By the emitting of a signal by the signal transmitter, one of the combined ball dispensers and ball receivers is indicated to the user as the selected ball dispenser and ball receiver.

When training a soccer player with the training device 1, a non-illustrated control device selects one of the combined ball dispensers and ball receivers as the ball dispenser, and the same or another of the combined ball dispensers and ball receivers 11 as the ball receiver. The signal transmitters that are assigned to the selected ball dispenser and the selected ball receiver then illuminate their opening and indicate them to the user as being selected. Subsequently, a ball is conveyed on the playing field by the selected ball dispenser. The soccer player on the playing field 10 now has to try to shoot the ball as quickly as possible into the selected ball receiver. Depending on the position of the selected ball receiver and ball dispenser, the conveying of the ball is of different difficulty. The degree of difficulty may also be increased by shortening the time in which the signal transmitters indicate the selected ball receiver and ball dispenser.

In memory means, both the point in time at which the ball is conveyed on the playing field by a ball dispenser and the point in time at which the user of the training device 1 shoots the ball into one of the combined ball dispensers and ball receivers 11 as the goal are stored. To this end, each ball receiver is provided with a receiving sensor that registers whether a ball has been shot through one of the openings 15. The receiving sensor may, for instance, be designed as a light barrier, or else register the balls that are positioned in the ball reservoir 14 of the combined ball dispensers and ball receivers 11.

By measuring these points in time, it may be examined whether the user has conveyed the ball into the correct ball receiver and, in addition, how much time the user has needed for forwarding the ball. These user-related data may be stored, and the data of different users may be compared with each other.

The training device is predominantly destined to train professional soccer players. Alternatively, the training device 1 may also be designed as a type of gaming machine and comprise a display panel on which the reaction times of the best users are indicated as a kind of "high score". By means of the training device 1 it is possible to measure reaction times and quickness of the users, and to compare them with each other.

The training device 1 may also be provided with a roof that closes the training device in an air-tight manner. By means of deoxygenation, the user of the training device may be trained under more extreme stress. The training device presented constitutes a basic scheme that can be enlarged. The playing field may, for instance, be used by several players at the same time, one of whom is played a ball by the ball dispenser which he has to play to a team-mate who, in turn, has to shoot it to the selected ball receiver. It is also possible to have two teams played against each other in a somewhat larger training device, wherein the ball receivers into which a ball on the playing field has to be conveyed, change from time to time.

LIST OF REFERENCE SIGNS

1 training device
2 gym
10 playing field
11 combined ball dispenser and ball receiver
11*o* upper ball dispenser and ball receiver
11*u* lower ball dispenser and ball receiver
12 selected ball dispenser and ball receiver
13 returning device
13*o* upper returning pipe
13*u* lower returning pipe
14 ball reservoir
15 opening

The invention claimed is:

1. A training device for training a user of the training device in a type of ball sport, comprising:

at least two ball receivers facing the user for interacting with a ball;

at least two ball dispensers for conveying a ball to the user; and at least one optical and/or acoustic signal transmitter configured to indicate to the user, by emitting an optical and/or acoustic signal, one of said ball receivers as a selected target for interacting with the ball conveyed to the user by one of said ball dispensers.

2. The training device according to claim 1, wherein the interacting of the ball with one of said ball receivers includes a reception of the ball by said ball receiver or the ball penetrating at least a part of said ball receiver.

3. The training device according to claim 1, wherein a signal transmitter is assigned to each of said ball receivers which indicates to the user, by emitting the optical and/or acoustic signal, the respective ball receiver as the selected target for interacting with the ball.

4. The training device according to claim 3, wherein the signal transmitters are arranged at said ball receivers.

5. The training device according to claim 1, further comprising a playing field for the user of said training device wherein said ball dispensers and said ball receivers face the playing field.

6. The training device according to claim 5, wherein said ball dispensers and/or said ball receivers are arranged at a boundary of the playing field.

7. The training device according to claim 6, wherein said playing field includes at least one ball dispenser and/or at least one ball receiver at all sides of the playing field.

8. The training device according to claim 7, wherein said playing field is completely surrounded by said ball dispensers and/or said ball receivers.

9. The training device according to claim 5, wherein said playing field includes an exchangeable floor.

10. The training device according to claim 1, wherein said ball receivers are designed simultaneously as ball receivers and as ball dispensers.

11. The training device according to claim 1, wherein a plurality of said ball dispensers and/or ball receivers is positioned on top of each other.

12. The training device according to claim 1, wherein an optical and/or acoustic signal transmitter is assigned to each of said ball dispensers, wherein these signal transmitters are designed and provided to indicate the respectively assigned ball dispenser as a selected ball dispenser which will convey the ball on the playing field.

13. The training device according to claim 1, wherein a random generator for selecting one of said ball receivers as the target of the ball that one of said ball dispensers conveys on said playing field, and/or for selecting one of said ball dispensers that will convey the ball on said playing field.

14. The training device according to claim 1, further comprising a returning device for returning the ball from one of said ball receivers to one of said ball dispensers.

15. The training device according to claim 1, wherein a control device controls one or more signal transmitters and the ball dispensers.

16. The training device according to claim 1, wherein a timing device measures a time needed by the user of said training device for conveying the ball from one of said selected ball dispensers to one of said selected ball receivers.

17. The training device according to claim 1, wherein a memory stores data of the user of said training device measured by a sensor.

18. The training device according to claim 17, wherein said memory stores user-related times measured by a timing device that measures a time needed by the user of said training device for conveying the ball from one of said selected ball dispensers to one of said selected ball receivers.

19. The training device according to claim 18, wherein said memory stores the user-related times as a function of the respectively selected ball dispenser and ball receiver.

20. The training device according to claim 1, wherein a receiving sensor is assigned to each ball receiver which senses whether the ball receiver has received the ball.

21. The training device according to claim 1, wherein said ball dispensers and/or ball receivers are constructed mechanically.

22. A method for training a user being on a playing field of a training device according to claim 1, comprising the steps of:

selecting a ball receiver for interacting with a ball;

emitting an optical and/or acoustic signal by the signal transmitter to indicate said selected ball receiver; and conveying the ball to the user by one of the ball dispensers.

23. The method according to claim 22, wherein a receiving sensor registers whether the ball arrives in the selected ball receiver.

24. The method according to claim 22, wherein, prior to the conveying of the ball to the user, a ball dispenser is selected to which an optical and/or acoustic signal transmitter is assigned, and which emits the signal before said selected ball dispenser conveys the ball on the playing field.

25. The method according to claim 24, wherein the selecting of said ball dispensers and said ball receivers is performed by a control device.

26. The method according to claim 22, wherein a controlled oxygen reduction is generated for the user of said training device.

27. A training device for training a user of the training device in a type of ball sport, comprising at least two ball receivers facing the user for interacting with a ball;

at least two ball dispensers for conveying the ball to the user;

at least one optical and/or acoustic signal transmitter that indicates to the user, by emitting an optical and/or acoustic signal, one of the ball receivers as a selected target for interacting with the ball that is conveyed to the user by one of the ball dispensers;

wherein each ball dispenser is simultaneously also a ball receiver, and a returning device configured to return a ball from one of said ball receivers to one of said ball dispensers.

28. A training device comprising:

a plurality of ball receivers, each ball receiver configured to face a user and to receive a ball from the user;

a plurality of ball dispensers, each ball dispenser configured to convey the ball to the user;

at least one optical signal transmitter configured to indicate to the user, by emitting an optical signal, which ball receiver of the plurality of ball receivers is a selected target for the user to interact with the ball conveyed to the user by one of the plurality of ball dispensers; and a returning device configured to return the ball from one of the ball receivers to one of the ball dispensers.

* * * * *

UNITED STATES PATENT AND TRADEMARK OFFICE

CERTIFICATE OF CORRECTION

PATENT NO. : 8,480,517 B2
APPLICATION NO. : 12/065557
DATED : July 9, 2013
INVENTOR(S) : Christian Richard Güttler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1438 days.

Signed and Sealed this
Eighth Day of September, 2015

Michelle K. Lee

Michelle K. Lee
*Director of the United States Patent and Trademark Office*